US006293397B1

(12) United States Patent
Chen

(10) Patent No.: US 6,293,397 B1
(45) Date of Patent: Sep. 25, 2001

(54) BALL-RECEIVING MEMBER

(76) Inventor: Chiu-Teh Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/595,231

(22) Filed: Jun. 16, 2000

(30) Foreign Application Priority Data

Jan. 31, 2000 (TW) ..... 89202017 U

(51) Int. Cl.[7] ..... B65D 85/00
(52) U.S. Cl. ..... 206/315.9; 206/315.3; 224/919
(58) Field of Search ..... 206/315.1, 315.3, 206/315.9; 224/919; 211/14, 15

(56) References Cited

U.S. PATENT DOCUMENTS

D. 394,548 * 5/1998 Lee ..... 3/221
3,968,522 * 7/1976 Riess ..... 2/250
4,850,483 * 7/1989 Stack ..... 206/315.9
5,183,154 * 2/1993 Stemp ..... 206/315.9
5,186,374 * 2/1993 Buxton ..... 224/191
5,326,005 * 7/1994 Fisher ..... 224/919
5,398,345 * 3/1995 Kenneth et al. ..... 2/247
5,772,090 * 6/1998 Rodriquez ..... 224/919
5,898,968 * 5/1999 Beattie ..... 224/919
8,839,631 * 11/1998 Hebert et al. ..... 224/919

* cited by examiner

*Primary Examiner*—David T. Fidei
(74) *Attorney, Agent, or Firm*—Alan Kamrath; Rider, Bennett, Egan & Arundel, LLP

(57) ABSTRACT

A ball-receiving member is attached to an object. The ball-receiving member includes an open side to allow insertion of balls and defines a receiving space therein for receiving a plurality of balls. The ball-receiving member is made of elastomeric material and includes a plurality of side holes in a side thereof. Each side hole retains an associated ball in place yet allowing passage of the ball upon manual squeezing at both sides of the ball-receiving member.

15 Claims, 7 Drawing Sheets

BALL-RECEIVING MEMBER

BACKGROUND OF THE INVENTION

1. Field of the Invention

The present invention relates to a ball-receiving member that is attachable to an object, such as a golf bag, tennis racket bags, etc, to thereby receive golf balls, tennis balls, etc.

2. Description of the Related Art

Many modem people play golf, tennis, table tennis, squash, baseball, etc. at leisure. However, these people have a common problem in carrying the balls. A player often puts two or three balls in the pockets of the sport pants, which results in an aesthetically unpleasing effect and adversely affects mobility of the player.

It is therefore a long and unfulfilled need for a ball-receiving member for solving the above-mentioned problem.

SUMMARY OF THE INVENTION

It is the primary object of the present invention to provide a ball-receiving member that is attachable to an object, such as a golf bag, tennis racket bag etc., to thereby receive golf balls, tennis balls, etc.

In accordance with one aspect of the invention, a ball-receiving member is attached to an object. The ball-receiving member comprises an open side to allow insertion of balls and defines a receiving space therein for receiving at least one ball. The ball-receiving member includes at least one side hole in a side thereof. The side hole allows removal of the ball received in the receiving space by means of forcibly passing through the side hole.

The ball-receiving member is made of elastomeric material. The side hole is conic and tapers outwardly. The side hole includes a minimum diameter that is smaller than an outer diameter of the ball received in the receiving space.

In accordance with another aspect of the invention, a ball-receiving member is attached to an object. The ball-receiving member comprises an open side to allow insertion of balls and defines a receiving space therein for receiving a plurality of balls. The ball-receiving member is made of elastomeric material and includes a plurality of side holes in a side thereof. Each side hole retains an associated ball in place yet allowing passage of the ball upon manual squeezing at both sides of the ball-receiving member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
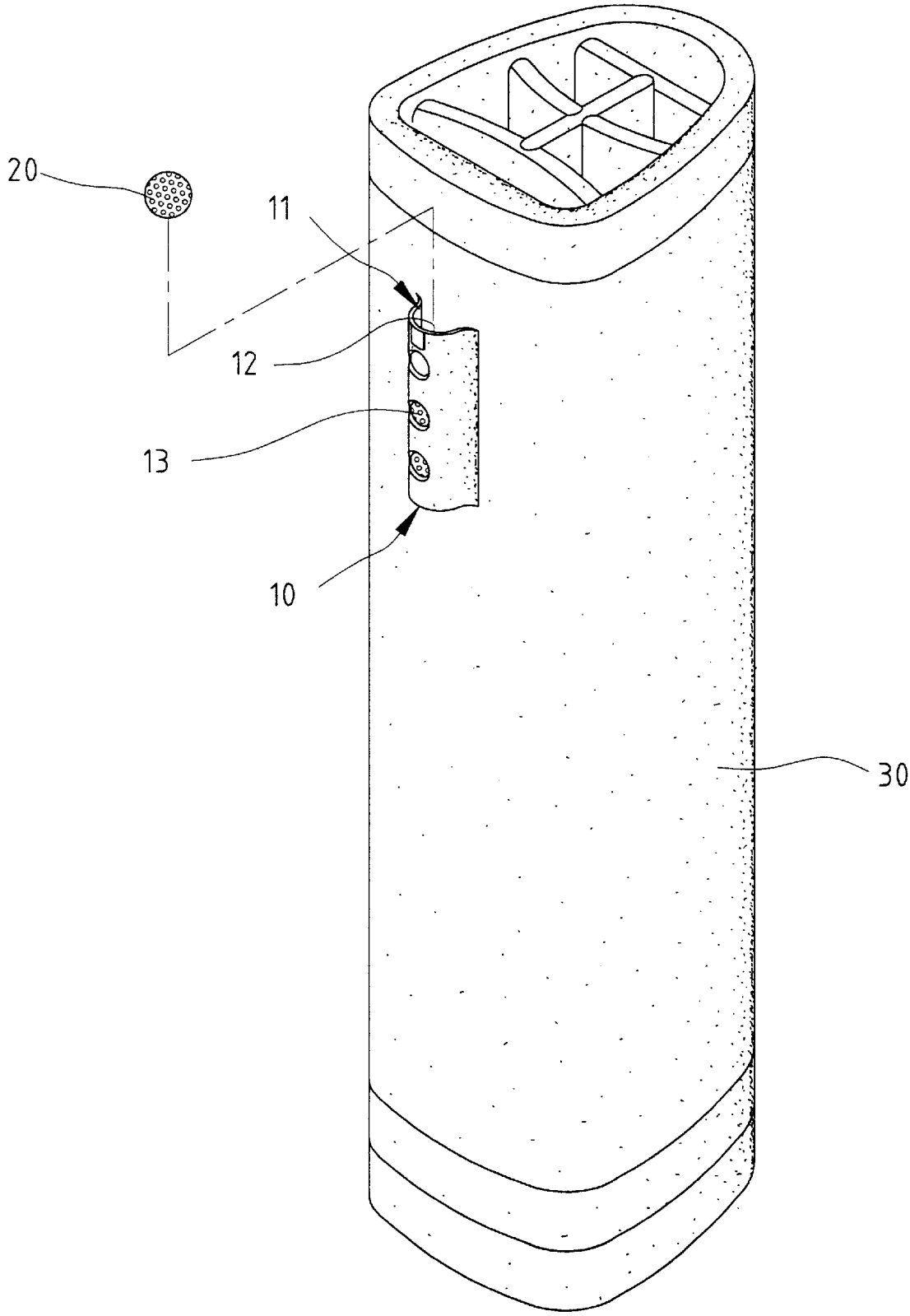
FIG. 1 is a perspective view, partly exploded, of a golf bag with a ball-receiving member in accordance with the present invention.
Figure 2:
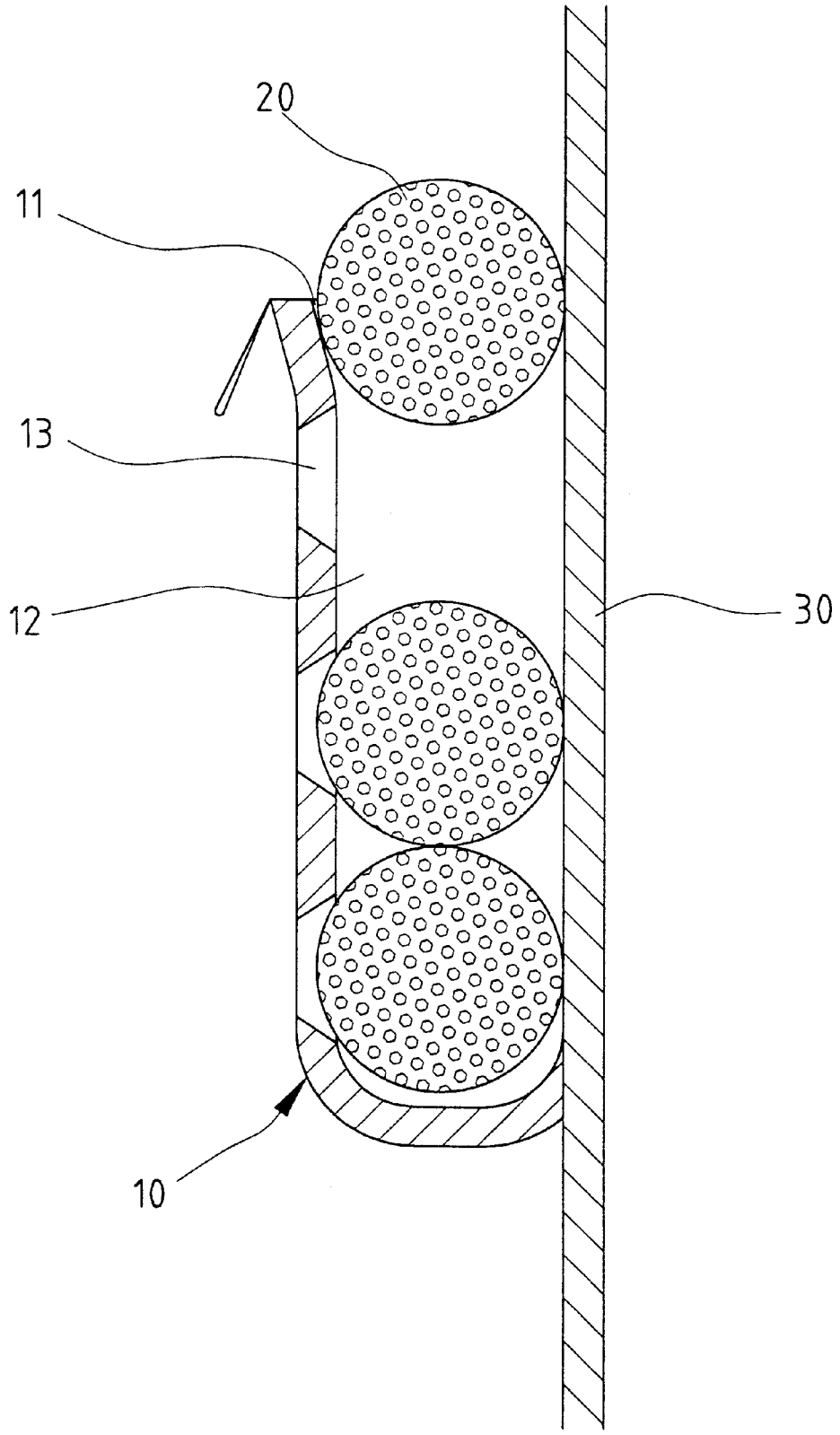
FIG. 2 is an enlarged sectional view of a portion of the golf bag and the ball-receiving member in accordance with the present invention, illustrating insertion of golf balls into the ball-receiving member.
Figure 3:
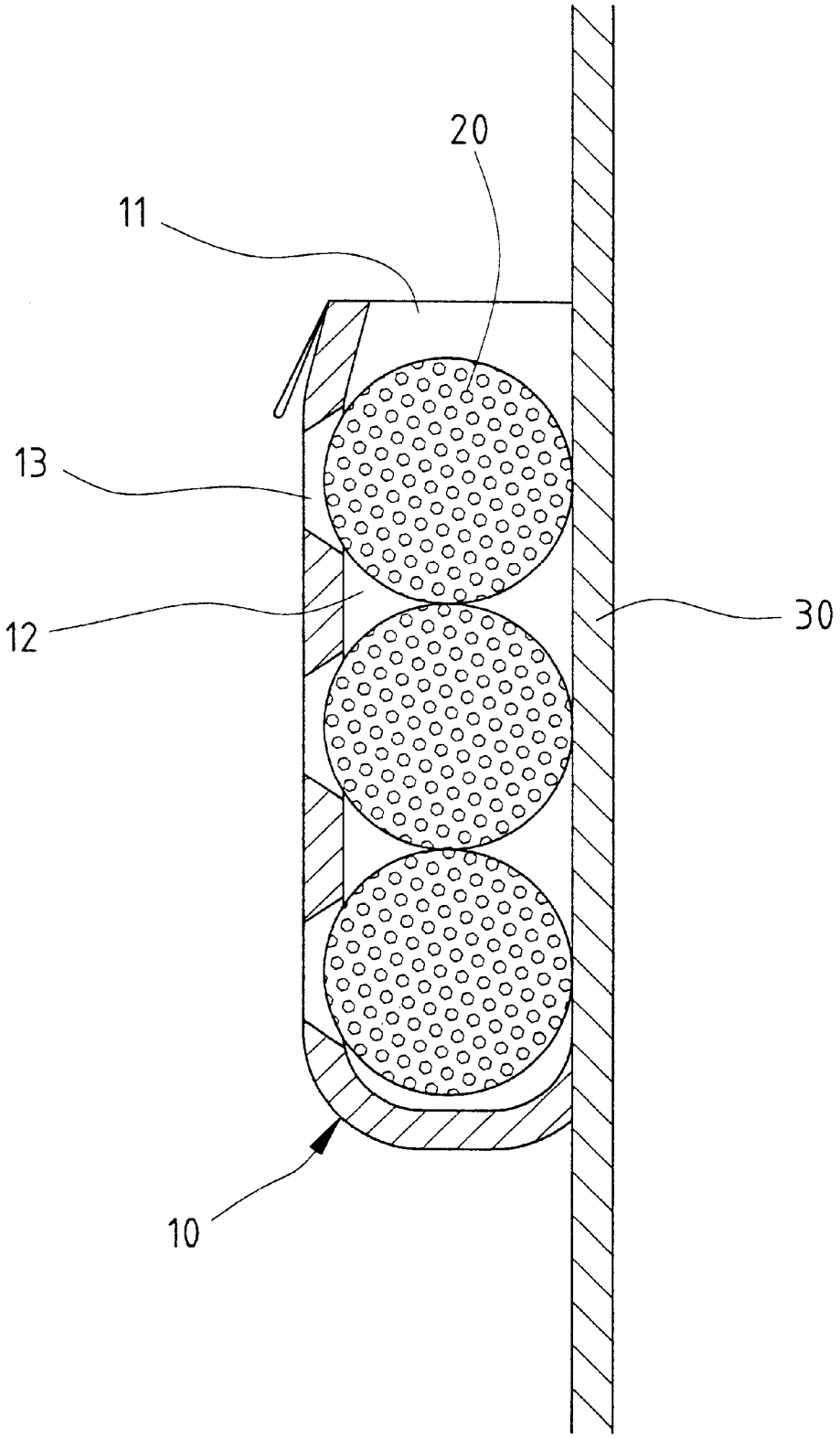
FIG. 3 is a sectional view similar to FIG. 2, wherein the golf balls have been retained in place.
Figure 4:
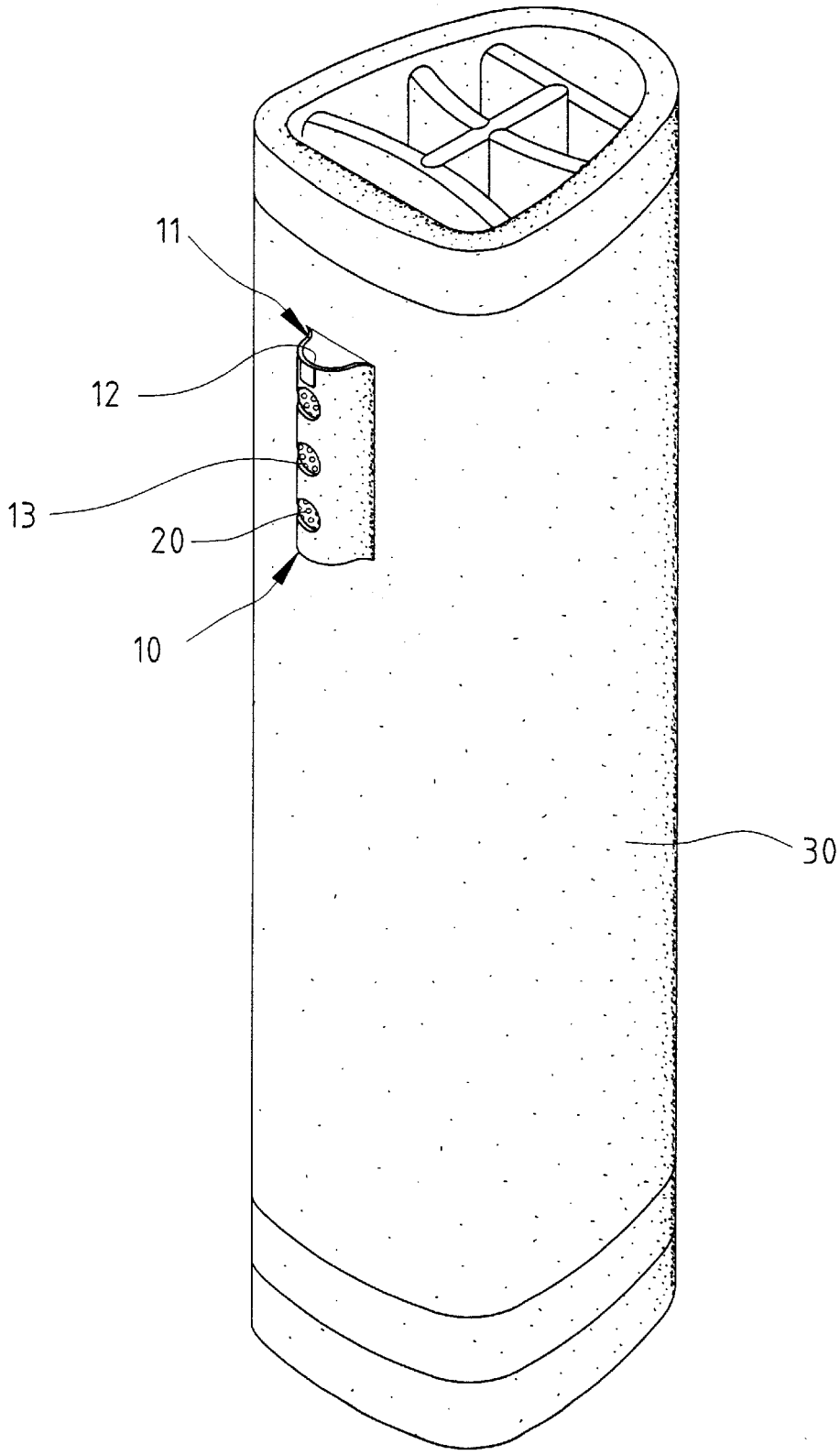
FIG. 4 is a perspective view of the golf bag with the ball-receiving member in accordance with the present invention.

Referring to FIGS. 1 and 2, a ball-receiving member 10 in accordance with the present invention is attached to an object (a golf bag 30 in this embodiment) for receiving golf balls 20. The ball-receiving member 10 is made of elastomeric material, such as nylon II neoprene to thereby provide excellent elastomericity and toughness. The ball-receiving member 10 includes an open end 11 and defines a receiving space 12 therein for receiving golf balls. A plurality of spaced side holes 13 is defined in a side of the ball-receiving member 10 and communicated with the receiving space 12. Each side hole 13 is conic and tapers outward, best shown in FIG. 2. The minimum diameter of each side hole 13 is smaller than an outer diameter of a golf ball 20. FIG. 2 illustrates insertion of the golf balls 20. The golf balls 20 are retained in place after they are inserted into the ball-receiving member 10, best shown in FIG. 3, as the conic side hole 13 embraces a portion of the spherical surface of the golf ball 20. Thus, a golf player may carry several golf balls 20 along with the golf bag 30 by provision of the ball-receiving member 10, best shown in FIG. 4.

Figure 5:
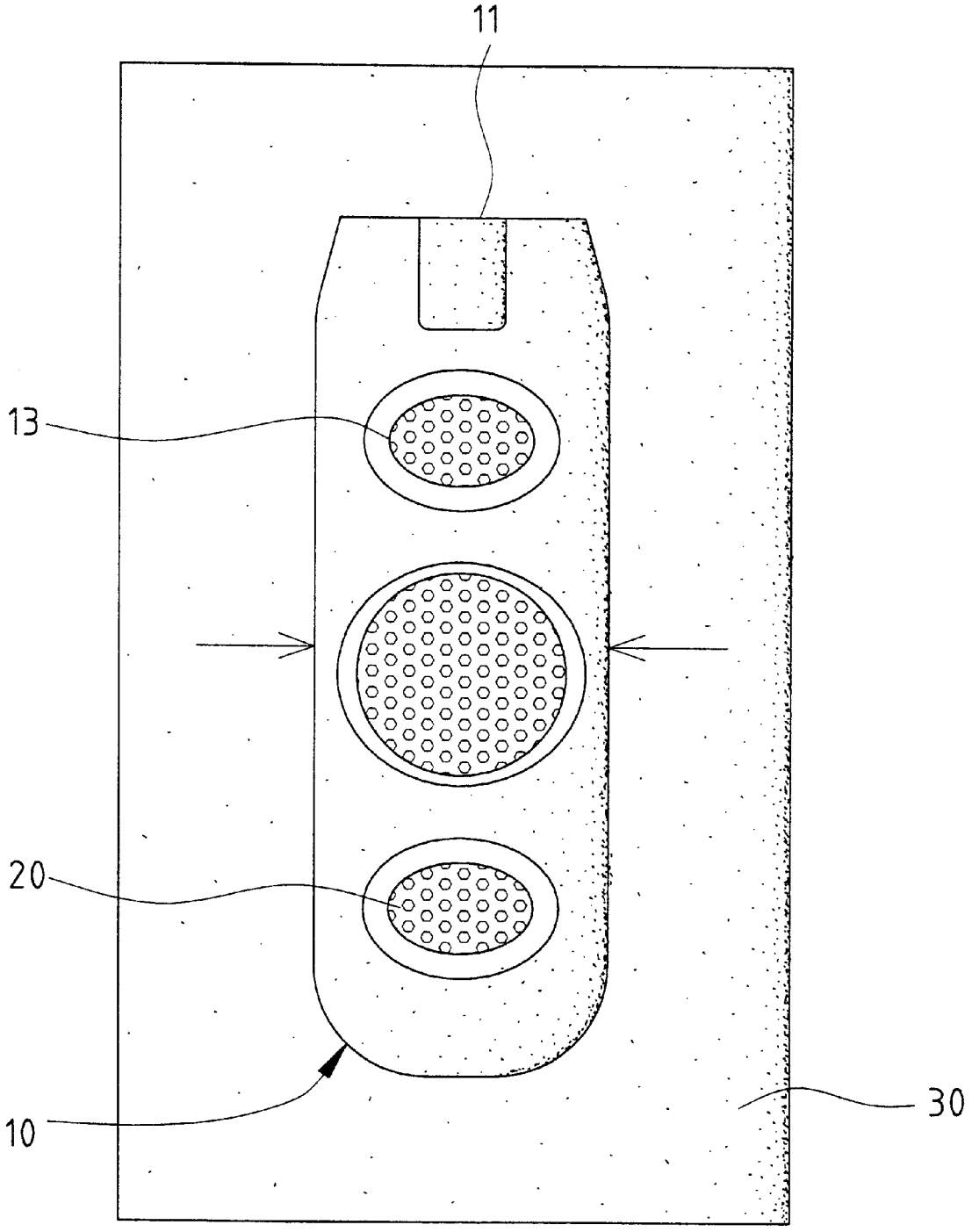
FIG. 5 is an enlarged elevational view illustrating a portion of the golf bag and the ball-receiving member in accordance with the present invention, illustrating removal of the middle golf ball by squeezing.
Figure 6:
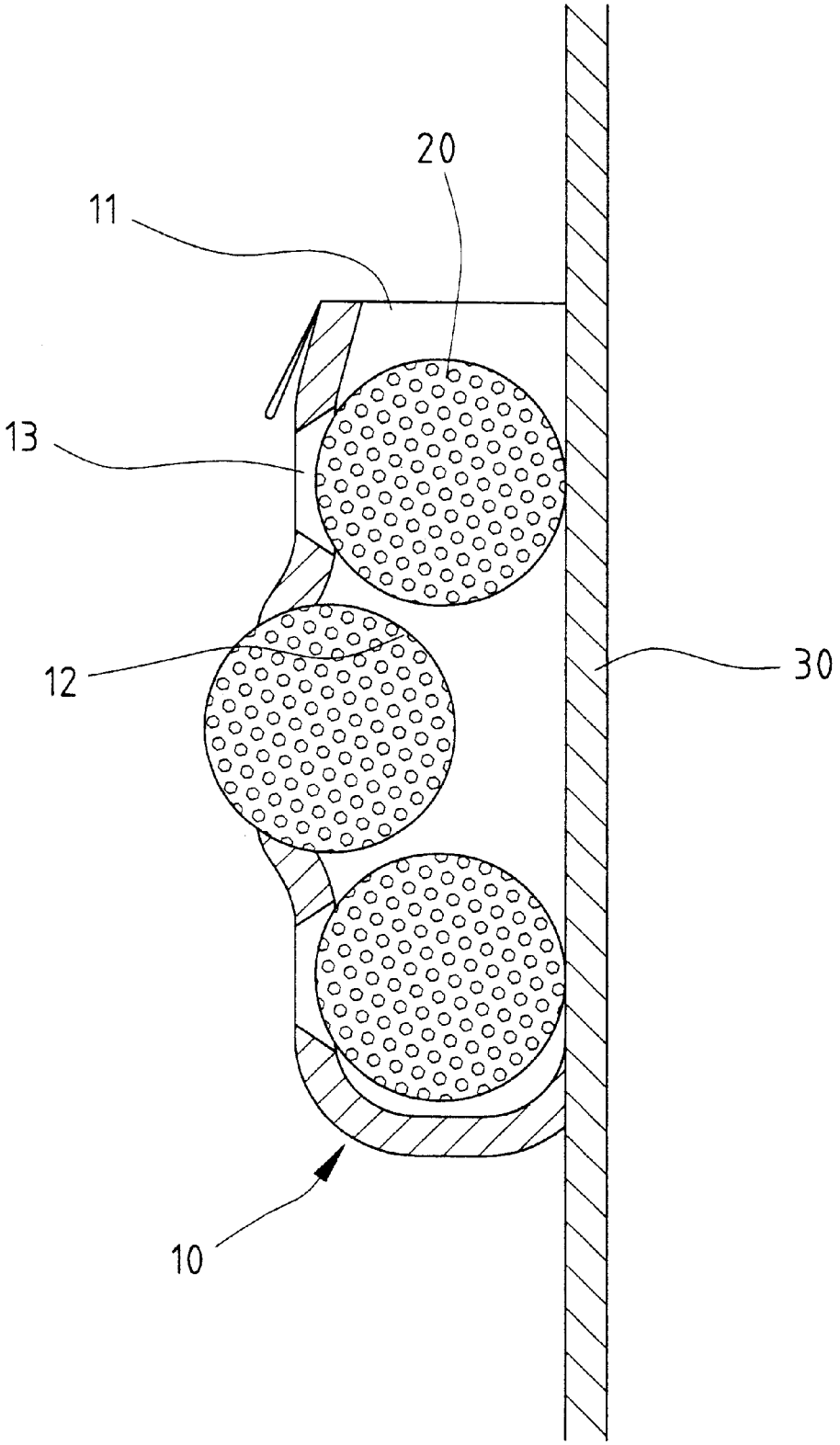
FIG. 6 is a sectional view similar to FIG. 3, illustrating removal of the middle golf ball by squeezing.

FIGS. 5 and 6 illustrate removal of the middle golf ball from the ball-receiving member 10. The user may use fingers to squeeze the ball-receiving member 10 at both sides, as indicated by arrows in FIG. 5. The middle golf ball 20 is forced to move outward. It is noted that the ball-receiving member 10 is made of elastomeric material such that the conic side hole 13 may be enlarged to allow passage of the golf ball 20.

Figure 7:
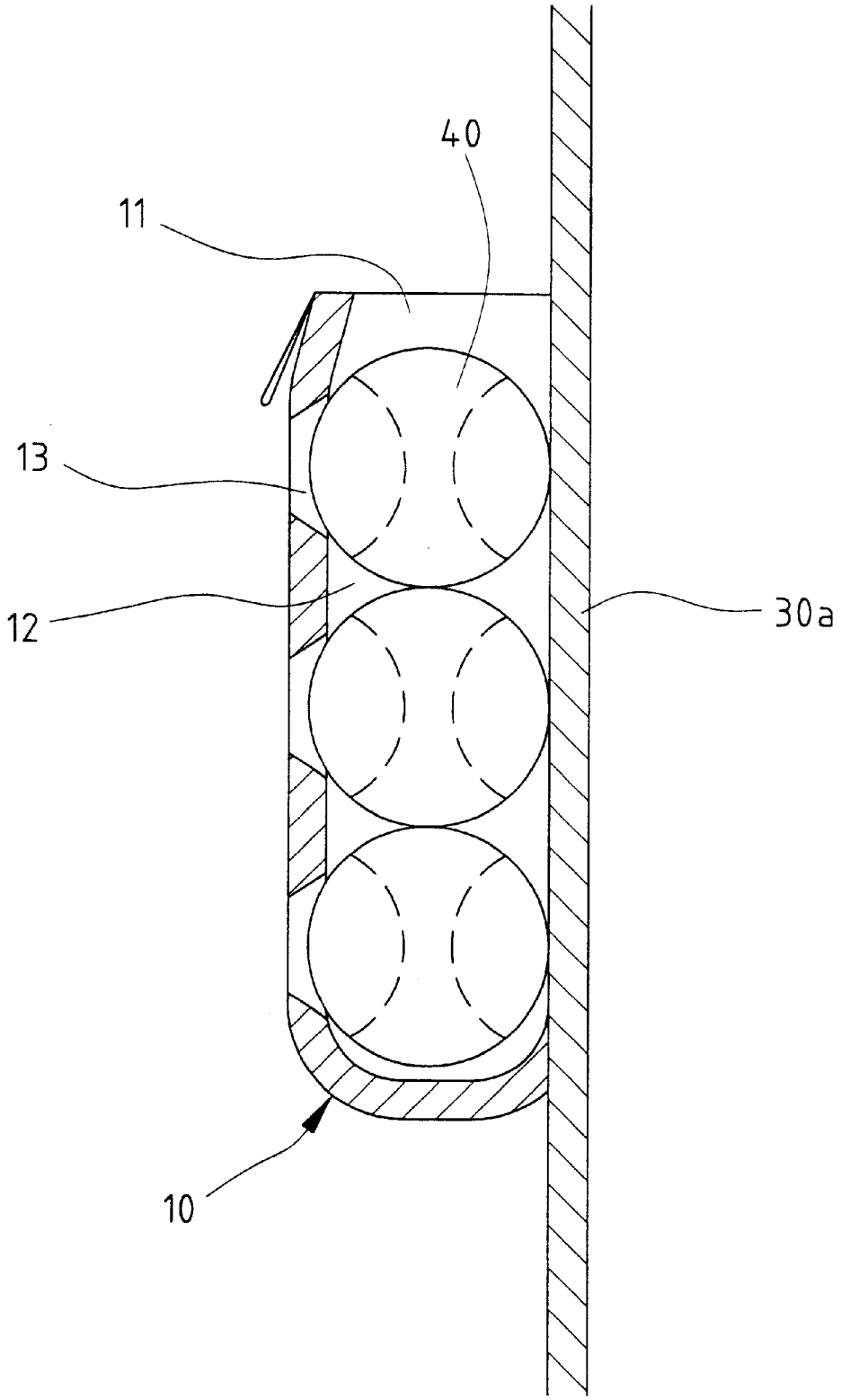
FIG. 7 is a sectional view similar to FIG. 3, wherein the ball-receiving member is used to receive tennis balls.

FIG. 7 illustrates use of the ball-receiving member 10 for receiving tennis balls 40 if the ball-receiving member 10 is attached to a tennis racket bag 30*a*.

Although the invention has been explained in relation to its preferred embodiment, it is to be understood that many other possible modifications and variations can be made without departing from the spirit and scope of the invention as hereinafter claimed.

What is claimed is:

1. A ball-receiving member adapted to be attached to an object, the ball-receiving member comprising an open side to allow insertion of balls and defining a receiving space therein for receiving at least one ball having a spherical surface, the ball-receiving member including at least one side hole in a side thereof, said at least one side hole allowing removal of said at least one ball received in the receiving space by means of forcibly passing through said at least one side hole, with said at least one side hole being conic and tapering outwardly into the receiving space and being of a size adapted to embrace a portion of the spherical surface of the ball received in the receiving space.

2. The ball-receiving member as claimed in claim 1, wherein the ball-receiving member is made of elastomeric material.

3. The ball-receiving member as claimed in claim 1, wherein said at least one side hole includes a minimum diameter that is smaller than an outer diameter of the ball received in the receiving space.

4. A ball-receiving member adapted to be attached to an object, the ball-receiving member comprising an open side to allow insertion of balls and defining a receiving space therein for receiving a plurality of balls each having a spherical surface, the ball-receiving member being made of elastomeric material and including a plurality of side holes in a side thereof, each said side hole retaining an associated said ball in place yet allowing passage of said ball upon manual squeezing at both sides of the ball-receiving member, with each said side hole being conic and tapering outwardly into the receiving space and being of a size adapted to embrace a portion of the spherical surface of the ball received in the receiving space.

5. The ball-receiving member as claimed in claim 4, wherein each said side hole includes a minimum diameter that is smaller than an outer diameter of the ball received in the receiving space.

6. Apparatus for holding a sports ball comprising, in combination: a bag for holding a sports device adapted to hit the sports ball; and a ball-receiving member attached to the bag, with the ball-receiving member including a channel having generally U-shaped cross sections and first and second edges, an open end, and a closed end, with the channel being attached to the bag with the first and second edges being in a spaced parallel relation coextensive with the bag, with a receiving space being defined by and between the channel and the bag and by and between the open and closed ends for receiving at least one sports ball, with the open end allowing the sports ball to be inserted into the receiving space therethrough, with the channel including at least one side hole in a side thereof opposite to the bag and communicating with the receiving space, with the side hole allowing removal of the sports ball from the receiving space through the side hole.

7. The apparatus of claim 6, with the side hole being conic and tapering outwardly into the receiving space and being of a size adapted to embrace a portion of a spherical surface of the sports ball received in the receiving space.

8. The apparatus of claim 7, with the channel formed of elastomeric material.

9. The apparatus of claim 8, with a minimum diameter of the side hole being smaller than an outer diameter of the sports ball received in the receiving space.

10. The apparatus of claim 9, with the channel being of a size to receive multiple sports balls, with the channel including multiple side holes each associated with one of the multiple sports balls.

11. The apparatus of claim 7, with a minimum diameter of the side hole being smaller than an outer diameter of the sports ball received in the receiving space.

12. The apparatus of claim 6, with the channel formed of elastomeric material.

13. The apparatus of claim 12, with the elastomeric material being nylon II neoprene.

14. The apparatus of claim 12, with a minimum diameter of the side hole being smaller than an outer diameter of the sports ball received in the receiving space.

15. The apparatus of claim 6, with the channel being of a size to receive multiple sports balls, with the channel including multiple side holes each associated with one of the multiple sports balls.

* * * * *